United States Patent [19]

Eyden

[11] 4,348,002

[45] Sep. 7, 1982

[54] HANGER FOR CONCRETE DECK FORMING APPARATUS

[76] Inventor: Everett A. Eyden, P.O. Box 1873, Sedona, Ariz. 86336

[21] Appl. No.: 265,036

[22] Filed: May 18, 1981

Related U.S. Application Data

[62] Division of Ser. No. 133,904, Mar. 25, 1980.

[51] Int. Cl.[3] ..... F04G 11/00

[52] U.S. Cl. ..... 249/19; 249/23; 249/24; 249/25; 249/187 R; 249/205; 249/207; 249/210; 249/211; 249/219 R

[58] Field of Search ..... 249/19, 23, 24, 25, 249/187, 205, 207, 210, 211, 219 R

[56] References Cited

U.S. PATENT DOCUMENTS

| | | | |
|---|---|---|---|
| 2,167,413 | 7/1939 | Bartlett | 189/37 |
| 2,985,936 | 5/1961 | Hillberg | 249/207 |
| 3,215,389 | 11/1965 | Williams | 248/327 |
| 3,737,132 | 6/1973 | Roth | 248/228 |
| 3,782,675 | 1/1974 | Boll et al. | 249/23 |
| 3,782,676 | 1/1974 | Boll et al. | 249/23 |
| 3,900,182 | 8/1975 | Berman et al. | 249/24 |
| 3,960,357 | 6/1976 | Honea, Jr. | 249/211 |
| 3,989,219 | 11/1976 | Pruett | 249/24 |
| 3,993,282 | 11/1976 | Berman et al. | 249/24 |
| 4,123,031 | 10/1978 | Hyre | 249/24 |
| 4,192,623 | 3/1980 | Borg | 403/232.1 |
| 4,223,866 | 9/1980 | Black | 249/211 |

*Primary Examiner*—James R. Hall

*Attorney, Agent, or Firm*—Cahill, Sutton & Thomas

[57] ABSTRACT

Top adjustable removable hangers depend from opposed walls, beams or girders to support length adjustable ledgers, which ledgers support deck joists and decking associated therewith and upon which a concrete deck will be poured to form a slab supported upon the walls, beams or girders. Means are incorporated to permit assembly from the top of the hangers, ledgers, deck joists and decking and means are included in the hangers to permit vertical adjustment of the ledgers from above or below to bring the decking to grade elevation. Further means are incorporated to permit disassembly of the hangers, ledgers, deck joists and decking from the bottom after cure of the poured concrete deck.

4 Claims, 10 Drawing Figures

HANGER FOR CONCRETE DECK FORMING APPARATUS

This is a division of application Ser. No. 133,904, filed Mar. 25, 1980.

The present invention relates to concrete construction apparatus and, more particularly, to hangers for adjusting the grade elevation of decking upon which a concrete deck is to be formed.

In the construction of bridges and buildings, concrete slabs are successively laid between the spans defined by spaced apart pairs of walls, precast concrete beams or steel girders. To pour the concrete, forms are prepared to support the concrete and any reinforcing materials imbedded therein. Generally, such forms include plywood decking supported upon wooden joists. The joists in turn are retained in place by beams extending across the span and secured in place by retaining elements temporarily or permanently disposed at walls or members defining the span.

In the prior art, there exist many types of concrete forms and apparatus for use in conjunction therewith, of which the following United States Patents are representative. U.S. Pat. Nos. 3,782,675 and 3,782,676 are directed to apparatus, including hangers, supported from steel beams of a bridge for supporting plywood decking upon which concrete is poured. The apparatus does not include the capability of adjusting the decking elevation to compensate for variations in dead load camber or for accommodating for differences in camber of the beams, which differences arise from beam manufacture tolerances.

U.S. Pat. No. 2,167,413 is primarily directed to decking support apparatus which is readily and easily strippable after curing of the concrete. No means for vertically adjusting the height of the decking is available.

U.S. Pat. Nos. 3,900,182 and 3,993,282 illustrates apparatus which requires substantial alterations of the concrete support members to attach the decking support apparatus, which modifications are not practical at most installations. Moreover, the procedure for installation and removal of the decking support apparatus entails high labor and material costs incurred in part by the necessity for building access platforms beneath the decking support apparatus.

U.S. Pat. No. 2,985,936 is directed to complex hardware part of which is not removable after formation of a concrete slab and which is subject to corrosion.

U.S. Pat. No. 3,737,132 teaches means applicable only to steel beam support members for adjusting the elevation of the decking from the bottom only and such adjustment is essentially very difficult to accomplish. Moreover, members cut to exact length must be employed which entails high labor and material costs.

U.S. Pat. No. 3,215,389 describes apparatus which is top adjustable but requires the installation of supporting members from the bottom and which supporting members must be cut to length.

U.S. Pat. No. 3,989,219 is directed to apparatus which must be fabricated to fit each beam and the apparatus is expendable. Transverse and longitudinal members cut to length are required and they must be attached from below unless modifications are made. Accordingly, high labor and material costs are incurred.

U.S. Pat. No. 4,123,031 provides apparatus having a top adjustment feature; however, assembly and disassembly and adjustment must be made from below, necessitating the construction of a work platform. Additionally, certain of the apparatus must be custom made for each installation.

It is therefore a primary object of the present invention to provide a hanger useable with concrete deck forming apparatus which hanger is adjustable from above or below to adjust the grade elevation for the concrete deck to be formed.

Another object of the present invention is to provide hangers useable in opposed pairs to temporarily support ledgers extending between a pair of hangers and temporarily supporting decking for a concrete deck to be built.

Still another object of the present invention is to provide top or bottom vertically adjustable hangers for supporting ledgers extending across a span.

Yet another object of the present invention is to provide readily removable hangers which temporarily support a concrete deck during curing thereof.

A further object of the present invention is to provide a hanger having a channel chase for receiving an end of a ledger and a vertically adjustable ledger support plate to vary the elevation of the supported ledger end.

A still further object of the present invention is to provide a hanger having a ledger support plate and threaded means for adjusting the ledger support plate from above or below.

A yet further object of the present invention is to provide a hanger for ledgers extending across a span which hanger is inexpensive to use in terms of labor and material costs.

These and other objects of the present invention will become apparent to those skilled in the art as the description thereof proceeds.

The present invention may be described with greater specificity and clarity with reference to the following drawings, in which:

FIG. 1 illustrates an installation of the present invention;

FIG. 1*a* illustrates a variant for employing ledger supporting hangers in conjunction with undercut beams or girders;

Figure 5A:
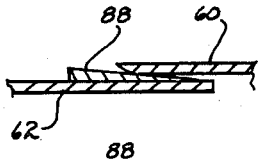
Figure 4A:
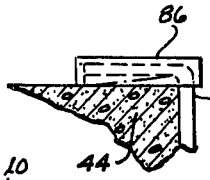

FIG. 4*a* is a detailed view illustrating a sheath for use in conjunction with each hanger; and FIG. 5*a* is a detailed view illustrating a means for maintaining a ledger extended at a predetermined length.

Whenever a slab of concrete is to be formed across a span intermediate walls, beams or the like, an impervious surface or decking must be at least temporarily established therebetween to retain the concrete when the latter is in a flowable state. This decking must be supported from underneath with sufficient support structure to withstand the weight of the concrete to be poured. This support structure can be supported by either scaffolding built beneath the span or by structural members depending from the walls or beams defining opposed sides of the span.

At many locations, such as bridges and high buildings, it is totally impractical to erect scaffolding. Therefore, the support structure is usually suspended from the opposed walls.

If installation of the support structure must be accomplished from underneath the span, a platform usually has to be built to support the workmen assembling the support structure. The expense in terms of both time and material to build such a platform is detrimental. Accordingly, it is preferable that the support structure be assembleable by workmen from the top of the walls or beams defining the span to be bridged. After the concrete deck has been poured and cured, it is preferable to employ the concrete itself as a suspending element for a depending platform, which platform provides a work area for workmen to disassemble and remove the support structure underlying the cured concrete.

Figure 1:
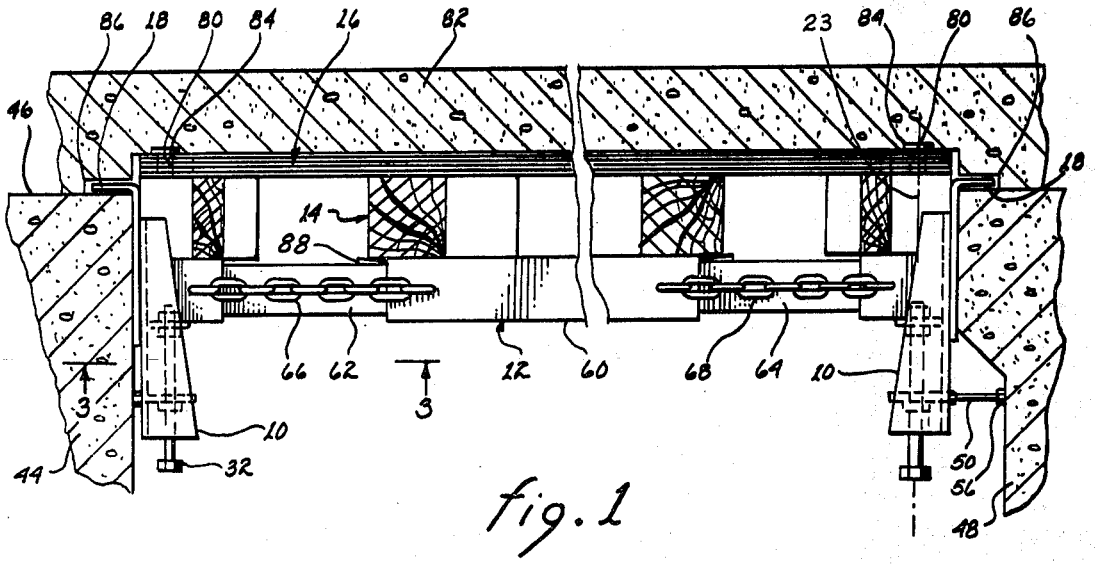
Figure 2:
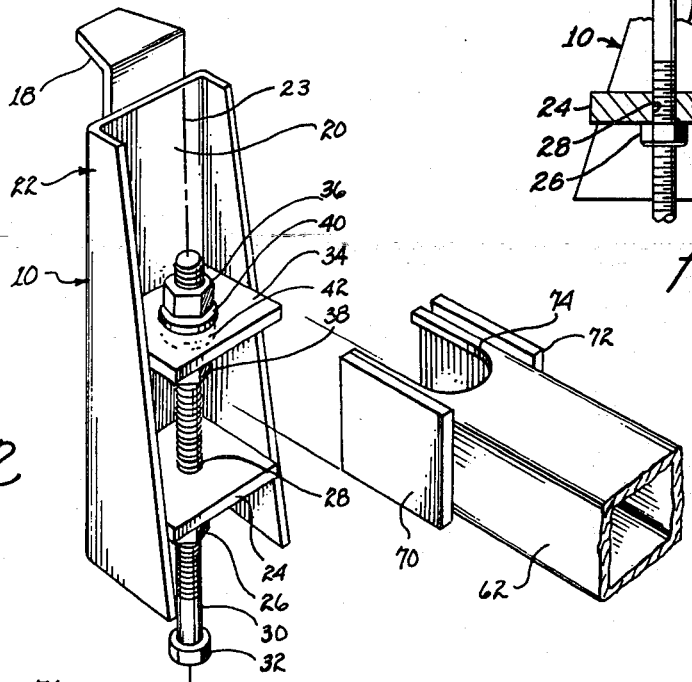
FIG. 2 is an isometric view illustrating a hanger and its relationship to the end of a ledger.

Referring jointly to FIGS. 1 and 2, there is illustrated a hanger 10 for supporting ledgers 12 extending across a span and upon which the ledgers, deck joists 14 and decking 16 are mounted. A hanger plate 18 is welded to base 20 of channel chase 22. A load transfer plate 24 is welded interior of the three sides, or at least two opposed sides of the channel chase. A nut 26 is welded to the bottom of load transfer plate 24 concentric with an aperture 28 disposed in the plate. Nut 26 is in threaded engagement with a threaded vertical adjustment rod 30 extending through aperture 28. A further nut 32 is welded to the bottom of the rod such that rotation of this nut produces commensurate rotation of the rod. An apertured ledger support plate 34, in slidable engagement with the interior surfaces of channel chase 22, is penetrably engaged by rod 30. Nuts 36 and 38 are welded to rod 30 on opposed sides of plate 34 in sufficiently spaced apart relationship to accommodate loosely mounted washers 40, 42.

From the above description, it will become evident that rotation of rod 30, whether by means of a force applied either to nut 32 or nut 36 by a socket wrench, will produce translation of rod 30 along its longitudinal axis and with respect to channel chase 22. A commensurate translation of ledge support plate 34 will also occur as movement thereof independent of the plate is precluded by nuts 36 and 38.

Figure 1A:
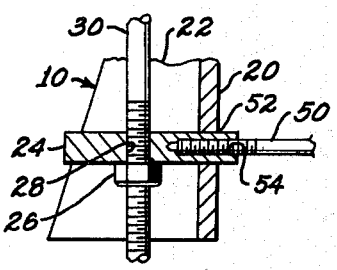

Referring primarily to FIGS. 1 and 1*a* it will be noted that hanger 10 is supported in a depending relationship upon wall 44 by hanger plate 18 resting upon surface 46 of the wall. Pivotal movement of the hanger toward and away from wall 44 is precluded by interference of the vertical depending part of the hanger plate and the base of the channel chase resting against the wall. However, where the supporting wall or beam is undercut, as depicted by wall 48 or where hanger 10 is suspended from an I-beam, girder or the like, pivotal movement of the hanger is not precluded. For installations wherein the supporting wall or beam is undercut, a gage rod 50 is incorporated with hanger 10 to prevent pivotal movement. The gage rod threadedly engages a threaded aperture 54 disposed in load transfer plate 24, a portion of which may extend through an aperture in the base of the channel chase. Alternatively, a threaded boss may be secured to the channel chase for receiving end 52 of the gage rod. The other end of the gage rod may include a nut 56 for applying a rotational force to the gage rod to vary the effective length of the gage rod commensurate with the extent of undercut of wall 48 of an I-beam, as the case may be.

Figure 3:
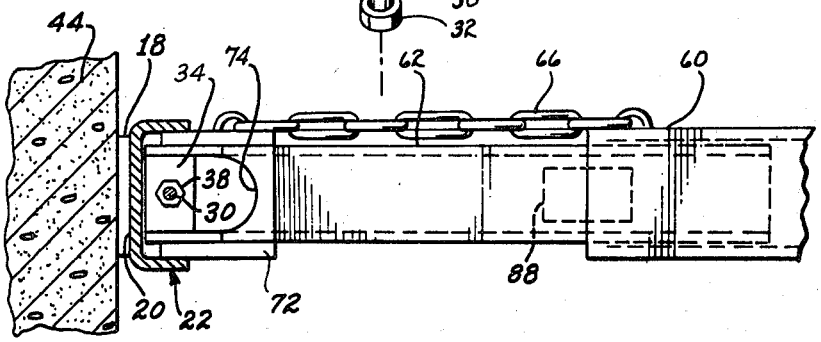
FIG. 3 is a side view of one end of a ledger.

Ledger 12 will be described with joint reference to FIGS. 1, 2 and 3. The ledger includes a central tube 60 for telescopically receiving end tubes 62 and 64. These end tubes are slidable into and out of the central tube to accommodate various spans intermediate walls 44 and 48 within a given span range. Chains 66 and 68 interconnect the central tube with the respective ones of the end tubes to limit the degree of extension of the end tubes such that sufficient overlap therebetween exists to maintain a predetermined load bearing strength. As particularly illustrated in FIG. 2, the extremities of the end tubes fit within chase 22 and rest upon ledger support plate 34.

To strengthen the extremities of the end tubes and distribute the loads therein, side plates 70 and 72 are welded at the extremities. Moreover, these side plates, rather than the bottom surface of the tube, rest upon the ledger support plate. The tops and bottoms of the end tubes are coped, as indicated by indentation 74, to accommodate rod 30 and nut 36 and also provide access thereto by a socket wrench or the like.

From the above description, it will become apparent that hangers 10 may be mounted upon walls 44 and 48 by a workmen positioned on top of the walls. Similarly, it will become apparent that ledger 12, after extension approximate that of the span between the two walls may be deposited within the respective channel chases of the hangers by the same workmen. Final extension and locking of the ledger to firmly place it upon the respective ones of the ledgers support plates can also be performed. After placement of the ledger, rods 30 of the respective hangers can be rotated to raise or lower the respective ledger support plates 34 to adjust the vertical position of the ledger.

After an appropriate number of hanger pairs and ledgers are dependingly supported by walls 44 and 48, deck joists 14 are laid thereacross to provide support for decking 16. These joists and decking are also positionable by workmen located at the top of walls 44 and 48. After decking 16 is in place, holes 80 are drilled therethrough, which holes are in approximate alignment with rod 30 of each of hangers 10. These holes now provide access to the respective nuts 36 by a tool having a socket mounted at the end thereof, such as a socket wrench. The tool is insertable through each of holes 80 to raise or lower the respective ledger support plates. Such adjustments of the ledger support plates, whether done before and/or after steel reinforcements are placed on the decking, produce a commensurate change in vertical location of the ledger, the supported deck joists and the decking to permit conformance of the decking to final grade elevation per specification. It may be again noted that final vertical adjustment of each of the ledgers is effected by workmen locatable at the top of walls 44 and 48.

After the proper elevation of decking 16 has been set, concrete 82 is poured upon the decking along with the laying of whatever imbedded reinforcement elements may be required. However, prior to such pouring, plates 84 are placed upon holes 80 to prevent a flow of concrete thereinto.

To prevent hanger plate 18 from becoming permanently imbedded to concrete 82, sheaths 86 are employed to enclose and protect the hanger plates from coming in contact with the concrete. For reasons which will become apparent below, the height of sheaths 86 is greater than the thickness of the hanger plate portion enclosed therein.

Referring jointly to FIGS. 4, 4*a*, 5, 5*a*, 6 and 7, the basic steps for assembling and disassembling the concrete deck forming system described herein will be reviewed. Pairs of hangers 10 are suspended at opposed locations from walls 44, 48 by engaging hanger plates 18 in depending relationship with the top surface of the walls. Hereinafter, the term "walls" will be used but it is to be understood that the hangers could be equally well supported from beams, girders or the like; moreover, where such walls, beams or girders are undercut, as illustrated in FIG. 1, gage rod 50 will be employed. As particularly depicted in FIG. 4*a*, the hanger plates are enclosed within sheaths 86 to protect the hanger plates against contact with the concrete which will ultimately be poured upon the top surface of walls 44 and 48. A ledger 12 is extended to a length generally commensurate with the span intermediate walls 44 and 48 and placed upon ledger support plates 24 of each opposed pair of hangers 10. After installation and final length adjustment, wedges 88, as illustrated in FIG. 5*a*, are driven intermediate central tube 60 and each of end tubes 62, 64. These wedges lock the tubes with respect to one another and preclude contraction or extension of the ledger.

After a sufficient number of ledgers have been placed intermediate walls 44 and 48 commensurate with the span and the load to be supported, deck joists 14 are placed transversely upon the ledgers. The number of deck joists, spacing therebetween and size are dependent upon the load to be carried and the degree of sag permissible of decking 16. After placement of decking 16 upon deck joists 14, holes 80 are drilled therein to permit access to rods 30 with a socket mounted tool, as explained above.

Vertical adjustment of decking 16 to grade and commensurate with various building codes and construction requirements is achieved by inserting the socket supporting tool through each of apertures 80 to turn the respective ones of rods 30. Such turning or rotation will, as described above, raise or lower the respective ledger support plate to raise or lower the respective end of the respective ledger.

After the desired elevation and slope of decking 16 has been achieved, plates 84 are placed upon each of holes 80 to preclude a flow of concrete thereto. The decking is now ready to receive whatever reinforcing members 89 may be required and concrete 82 may be poured thereupon to the requisite thickness.

Figure 6:
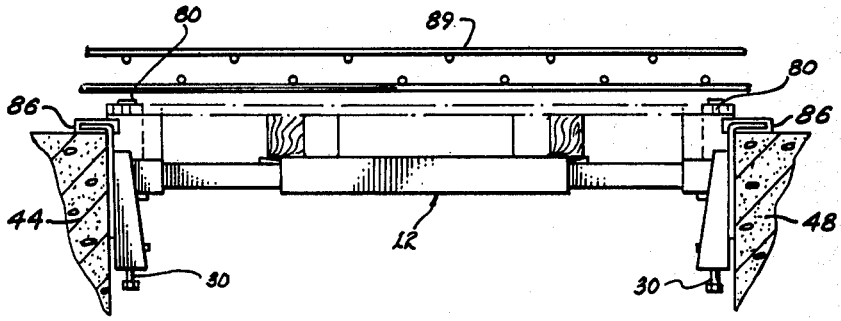
Figure 5:
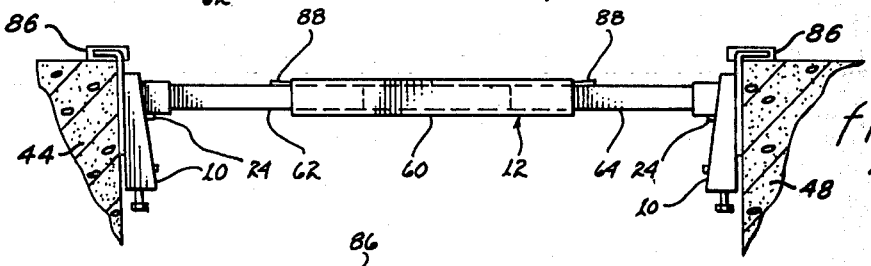
Figure 4:
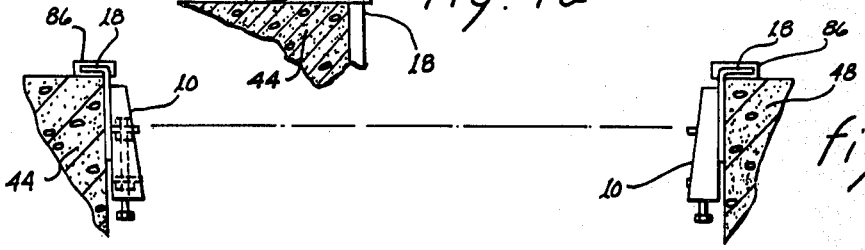

From the above description with respect to FIGS. 4, 5 and 6, it will become apparent that the present deck forming system is assembleable by workmen located upon walls 44 and 48; that is, there exists no need whatsoever for constructing a platform beneath ledgers 12 to install any of the components of the system. This benefit is substantial in terms of time, labor costs and material costs.

It is to be noted that the height of the decking with respect to walls 44 and 48 may be below the tops of the walls. To accommodate such a location, the decking would be recessed commensurate with the hangers. Conventional and well known techniques would be employed to preclude incursion of the flowable concrete into contact with the hangers.

Figure 7:
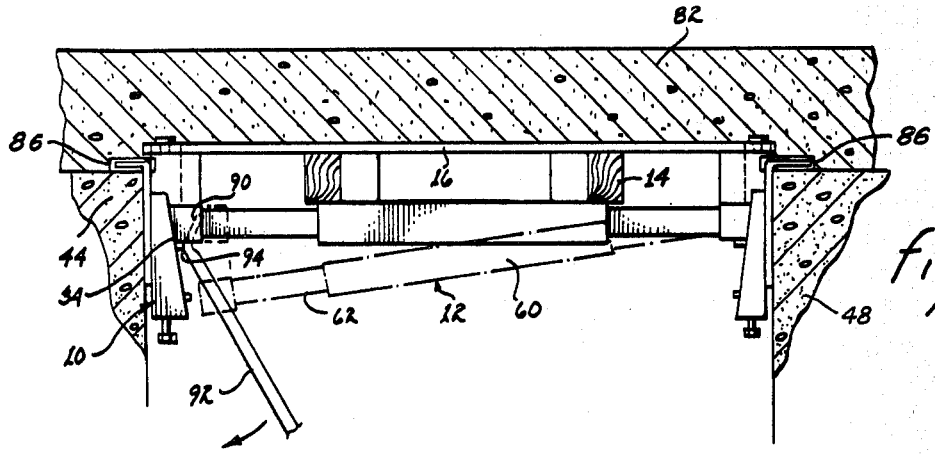
FIGS. 4, 5, 6 and 7 illustrates various steps in assembling and disassembling the present invention during the process of forming a concrete deck across a span.

Referring to FIG. 7, the process for disassembly of the deck forming system will be described. After concrete deck 82 has cured and is now capable of supporting loads as well as its own weight, the deck forming apparatus may be removed. To effect such removal, it is necessary that workmen have access to the deck forming apparatus from a point beneath the slab of concrete. As the concrete is now capable of supporting a load, a platform is easily suspendable from the concrete itself to provide a work space for the workmen. Accordingly, a platform is readily constructable irrespective of the height of the slab of concrete above the ground or next lower floor.

To initiate removal, wedges 88 are removed from intermediate central tube 60 and end tubes 62, 64 to permit ledger 12 to contract telescopically. Subsequent or prior thereto, ledger load plates 34 are lowered by applying a rotational force to nuts 32 to turn rod 30. End 90 of stripping bar 92 is inserted within indentation 74 (see FIG. 2) in the bottom surface of end tube 62. Bend 94 of the stripping bar is placed adjacent the side of ledger supporting plate 34 and serves as a fulcrum about which the stripping bar is rotated. Upon such rotation, end tube 62 will be telescopically contracted within central tube 60. The above process may or may not have to be repeated with respect to end tube 64, depending upon whether end tube 62 contracts sufficiently to free the extremity of the end tube from the ledger support plate. Upon sufficient contraction of ledger 12, it will be free of the respective hangers and it may be removed by the workmen.

Hangers 10 are removed by sliding them horizontally away from the respective walls until the hanger plate is free of the enclosing sheath. Alternatively, to free the hanger, it may have to be pivoted away from the wall which pivotal movement is accommodated by the excess height of sheath 86, as depicted in FIG. 4*a*.

Deck joists 14 and decking 16 are removed by conventional techniques well known to those skilled in the art.

It may be pointed out, that the removal of hangers 10 may be effected prior to removal of the deck joists, intermediate removal of the joists and the decking or subsequent to removal of the decking, depending upon factors unique to the location at which the deck forming system is used.

From the above description with reference to FIG. 7, it may be noted that all of the activity attendant removal of the deck forming system is accomplished from beneath the slab of concrete and the workmen can proceed in an orderly and efficient manner.

To reiterate certain benefits of the present invention over that of the prior art, scaffolding need not be constructed as is normal at building sites or low bridges and elaborate expensive platforms need not be constructed during assembly of the present concrete forming system as is normally true with respect to high bridges. Upon disassembly, the formed concrete slab itself extending across the span may serve as the anchor point for any platform necessary to provide the work space for the workmen and vitiates the need for scaffolding or other expensive platform support apparatus. However, a conventional rolling scaffold may be used where the site permits. Finally, all assembly work can be done from the top and all disassembly work can be done from the bottom.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A hanger for use with removable deck forming apparatus to suspend temporarily ledgers intermediate support elements defining the span of the deck to be formed, said hanger comprising in combination:

(a) a channel chase having a base and opposed sides;

(b) a threadedly apertured load transfer plate secured to said channel chase;

(c) a threaded rod in threaded engagement with the aperture of said load transfer plate, said rod being located in general alignment with the longitudinal axis of said channel chase;

(d) an apertured ledger support plate penetrably mounted upon said rod for supporting an end of a ledger;

(e) means for translating said ledger support plate longitudinally within said channel chase upon rotation of said rod;

(f) means for suspending said hanger from the support element; and (g) means for rotating said rod from either the top or bottom of said rod to raise and lower said ledger support plate and the supported end of the ledger whereby the grade elevation of the deck to be formed between the support elements may be adjusted.

2. The hanger as set forth in claim 1 wherein said suspending means includes a hanger plate secured to and extending from said channel chase.

3. The hanger as set forth in claim 2 including an adjustable gage rod extending from the lower end of said channel chase for supporting engagement with the support element.

4. The hanger as set forth in claim 2 wherein said hanger plate includes a removable sheath for protectively enclosing a part of said hanger plate.

* * * * *